United States Patent [19]

Mascetti

[11] Patent Number: 4,474,040

[45] Date of Patent: Oct. 2, 1984

[54] MACHINE FOR CHAMFERING PIECES OF HIDE, LEATHER AND SYNTHETIC MATERIALS OF SMALL THICKNESS, PARTICULARLY FOR SHOE AND LEATHER FACTORIES

[75] Inventor: Paolo Mascetti, Milan, Italy

[73] Assignee: Camoga S.p.A., Italy

[21] Appl. No.: 341,329

[22] Filed: Jan. 21, 1982

[30] Foreign Application Priority Data

Jan. 30, 1981 [IT] Italy ..... 19433 A/81

[51] Int. Cl.[3] ..... C14B 1/14

[52] U.S. Cl. ..... 69/16

[58] Field of Search ..... 69/6.5, 9, 9.5, 16

[56] References Cited

U.S. PATENT DOCUMENTS 2,733,588 2/1956 Stacey et al. ..... 69/6.5

2,938,369 5/1960 Braun ..... 69/9.5

4,338,803 7/1982 Paccagnella ..... 69/16

*Primary Examiner*—Werner H. Schroeder

*Attorney, Agent, or Firm*—Darby & Darby

[57] ABSTRACT

The invention relates to a machine for chamfering pieces of hide, leather and synthetic materials of small thickness, in which all the operating machine members, and particularly the rotary cup-shaped blade, the feed roller for feeding the piece to be chamfered and the grinder to sharpen the cup-shaped blade are driven by independent power units. Said machine is also provided with means for the non volatile storage of working programs and for the automatic execution of diversified operating phases according to said programs, with the possibility of interrupting the program, enabling the manual operation of the operating members, and of restoring it after the manual operation.

10 Claims, 8 Drawing Figures

MACHINE FOR CHAMFERING PIECES OF HIDE, LEATHER AND SYNTHETIC MATERIALS OF SMALL THICKNESS, PARTICULARLY FOR SHOE AND LEATHER FACTORIES

FIELD OF THE INVENTION

This invention relates to a machine for chamfering pieces of hide, leather and synthetic materials having a small thickness, particularly for shoe and leather factories, comprising, within a box-shaped body, a rotary cup-shaped blade, a feed roller for feeding pieces to be chamfered, disposed at right angles and inside said cup-shaped blade with one generatrix thereof substantially on a level with the cutting edge of the blade, a guide foot or guide roller for the material fed thereto, placed above said cup-shaped blade, a grinder to sharpen the cup-shaped blade, disposed laterally to the latter, and a member suitable to dress the grinder surface.

BACKGROUND OF THE INVENTION

At present there are two types of chamfering machines the essential differences of which reside in the different possibilities of adjusting the guide foot which, in one case, has a fixed positioning adjustable by hand, while the other case can take a certain number of predetermined positions.

However, the two types mentioned above are based upon one common conception of the machine which is generally provided with a single motor suitable to carry out the transmission of all necessary motions. The moving members are the chuck to hold the blade, the grinder to sharpen the blade and the roller which carries out the feeding of the material to be chamfered carrying it to the cutting station.

In said machines it is also provided a clutch which allows the material feed roller to be disconnected in order to be able to change, within the limits allowed by the slip of the clutch, the rotation speed of the feed roller in connection with the speed of the blade and of the spring.

It is to be noted that in both types of chamfering machines the different members are located within an open box-shaped body which has to be fixed, with its opening turned downwardly, on a carrying plane disposed on top of a bearing framework.

In non automatic chamfering machines the guide or reference foot can be adjusted exclusively by hand. The foot is mounted on an adjustable support and can take any desired position owing to the presence of devices which are connected to adjustment handles; in this case, the foot is not provided with a next pitch. This means that once the position to be taken by the foot has been determined, the workpiece can be thinned according to one predetermined amplitude and angle only. If the angle or the chamfering depth have to be changed, as the piece for example needs two or more different workings, it is necessary to act manually each time on the adjustment handles in order to set the foot in the most suitable position.

On the contrary, in the so-called automatic chamfering machines or program machines different types of chamfering can be carried out as the foot can take different predetermined positions as to its height, slope and depth. Practically, owing to a mechanical device, the machine can be arranged to accomplish three different chamfers. In this case the foot is placed so that it is ready to perform a certain type of chamfer having a given slope, height and depth. When this foot programming has been carried out, acting on a mechanical selector operable by pedal or push-button, it is possible to change the foot position so that the latter can take one of the two other predetermined positions.

In this type of machines too the setting of the foot, within the graduation limits, can become continuous by previously interfering in the mechanical adjusting device. In other words, if chamfers having different features with respect to the ones obtainable by means of the three above mentioned settings are desired, it is necessary to act manually on mechanical setting devices by programming other foot positionings.

However these types of machines have many drawbacks.

A first drawback, connected to the mechanical basic conception of the machine, resides in the fact that the rotary cup-shaped blade, the feed roller to feed the piece to be chamfered and the grinder to sharpen the cup-shaped blade are mechanically interconnected, so that it is not possible to accomplish a variation in the motion of one of these members without varying the motion of the other members. This means that if the rotation speed of the cup-shaped blade has to be changed, the rotation speeds of the grinder and the feed roller are automatically changed. In order to prevent the latter speeds from changing it is necessary to interfere in the different members transmitting motion, for example it is necessary to miss some belts, to change ratios between gears or to carry out other similar operations, which involves a remarkable loss of time on the part of the operator and therefore a corresponding non use of the machine.

In chamfering machines in which the use of a clutch is provided in order to disconnect the movement of the feed roller from the movement of the cup-shaped blade and the grinder, it is possible to change, or in any case to rectify within a predetermined limit, the rotation speed of the feed roller with respect to the rotation speed of the other members mentioned above, letting the clutch conveniently slide. It is to be noted however that in this case the change of speed of the material to be fed appears approximate and difficult to set and it is always entrusted to the operator's personal evaluation.

Another drawback connected with the basic conception of known chamfering machines is that these machines must be very often submitted to maintenance; this is due to the wear of the clutch when it is envisaged, as it is continuously submitted to sliding in order to set the roller speed, and to the wear of some mechanical pieces which are submitted to an overstress or in any case to a stress non proportionate to their sizes which in present solutions must necessarily be reduced owing to lack of room.

Among these members it is necessary to remember the joint transmitting the movement from the motor shaft to the chuck carrying the cup-shaped blade. This joint must be of the extensible type so that, when it acts at its maximum elongation position, it is subject to vibrations which compromise its life, causing a quick wear of same, and giving rise to many problems as to the correct transmission of movement.

The mechanical unit which transmits the rotary motion to the unit destined to the feeding of the material is also subject to get easily and quickly worn. This unit, based on a worm screw-helical gear coupling, on one hand must necessarily have a small size due to lack of room, while on the other hand is submitted to continuous, wearing stopping and starting stresses originated from the fact that transmission occurs through a clutch.

Furthermore, the passage of movement through a plurality of members very small in themselves involves a big problem as to the accuracy of a work; in fact a small error brought by an upstream member becomes a bigger error when it reaches the members acting on the piece to be chamfered.

Further drawbacks are present in the guide feet, either in the case of feet having a single manual positioning, or in the case of feet having a multiple program positioning. In both cases the different positionings are accomplished by means of a series of controls resulting from cams, mechanical stops, levers and from a plurality of kinematic motions involving a great number of small sized components, which are obliged to work in a particularly heavy environment placed near the sharpening area of the blade. The material removed during the grinding such as emery and steel dust, lying in this area, damages the above mentioned components, which involves the necessity of a very frequent overhaul, cleaning and adjustment of same.

As to the chamfering machines provided with a programmable foot, it is to be noted that at present it is possible to program a rather restricted number of workings (three) on the machine, which is not sufficient to meet all the requirements of the modern production. Furthermore, once the three workings have been programmed, by suitably positioning the guide foot, it is possible to work only on the basis of the three programmed positions; if it is desired to accomplish a chamfering which is not contemplated by the program, it is necessary to interfere in this program, to carry out the chamfering which was not contemplated and to interfere again in the devices so that the machine can go back to its initial conditions. Obviously this involves a remarkable loss of time on the part of the operator and consequently a slackening of production.

It is also to be noted that in all the solutions hitherto known in the art it is not provided a detector suitable to detect the position of the fore cutting edge of the blade, while it is very important for the blade to keep a precise axial position, depending upon the material to take away. Actually, when it is necessary to pass from one material having particular features of thickness and hardness to another material of different features the operator, acting on the handles, must move forward or backward the blade edge till it reaches a suitable position; however this position is stated according to the operator's judgment and is not pointed out by any reference in the machine.

The blade wear due to sharpening operation is submitted to a similar check too. In fact, even if the blade edge takes an optimal position at the beginning of a working, the grinder action causes the blade edge to move backward, so that after a certain time it is necessary to accomplish a new forward positioning.

After all, it is clear that the different necessary adjustments and handlings are left to the operator's evaluation and to his skill and experience. Therefore, the success in a work and the time necessary for its execution depend on the operator's ability.

OBJECTS

It is an object of the present invention to accomplish a chamfering machine in which the different adjustments of the rotary cup-shaped blade, the grinder and the feed roller can be carried out quickly and completely independently.

Another object of the present invention is to accomplish a very rational chamfering machine in which the various members are suitably sized according to the stresses they have to endure and can be easily reached when they need to be cleaned or repaired.

A further object of the invention is to perform a program chamfering machine which can be programmed for an unlimited number of workings and which is versatile in use, so that it can easily pass from the programmed working to any other single working and then come back as much easily to the planned program.

SUMMARY OF THE INVENTION

These and other objects which will become more evident from the description which follows are attained, according to the present invention, by a machine for chamfering pieces of hide, leather and synthetic materials of little thickness, particularly for shoe and leather factories, characterized in that said rotary cup-shaped blade, said material feed roller, said grinder and said guide foot are kinematically disconnected from each other, as they are driven by independent power units, in that said member to dress the grinder surface is provided with adjustment means adapted to set the positioning thereof and in that the foot and the corresponding stop device can repeatedly carry out diversified operating phases on the workpiece according to different operating programs previously stored in electronic means, said phases being suitable to be repeated at will according to a control on the part of the operator, the automatic working being arranged to be interrupted at any moment in order to carry out a different single working of the same members and to be restored, after such single working, according to the programmed cycle, said electronic means being also able to detect the reference position of the cup-shaped blade and to determine the different positionings of same according to its wear and to the pieces to be worked by means of either continuous or stepped displacements of said blade.

Further features and advantages of the invention will appear more evident from the detailed description of a preferred embodiment of a machine for chamfering pieces of hide, leather and synthetic materials having a small thickness, given hereinafter, by way of example only, with reference to the accompanying drawings.

DESCRIPTION OF A PREFERRED EMBODIMENT

Figure 1:
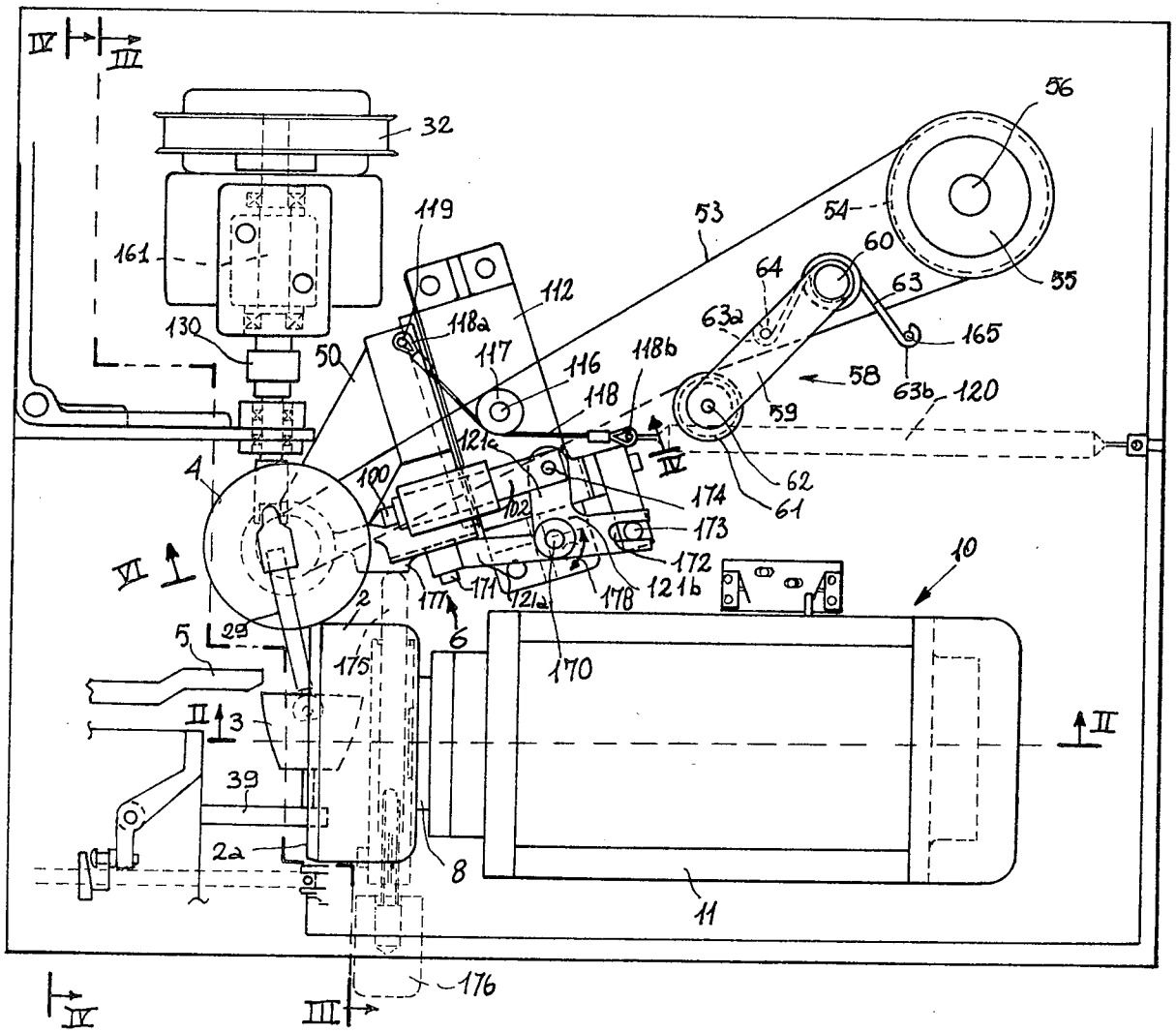
FIG. 1 is a plan view of the machine according to the invention.

Referring particularly to FIG. 1, the machine according to the invention, as to its essential members, comprises a rotary cup-shaped blade 2, a feed roller 3 suitable to feed the workpiece to the cutting edge 2*a* of the rotary cup-shaped blade 2, a grinder 4 suitable to sharpen the cup-shaped blade 2 and disposed laterally to the latter, a foot or positioning roller 5 suitable to guide the workpiece, disposed in the vicinity of the feed roller 3 and a member, generally indicated at 6, suitable to dress the working surface of grinder 4.

The above mentioned members are located in a box-shaped body, generally indicated at 20, open upwardly and adapted to be closed, by means of screws, by a conveniently shaped cover not shown in the figures.

Figure 2:
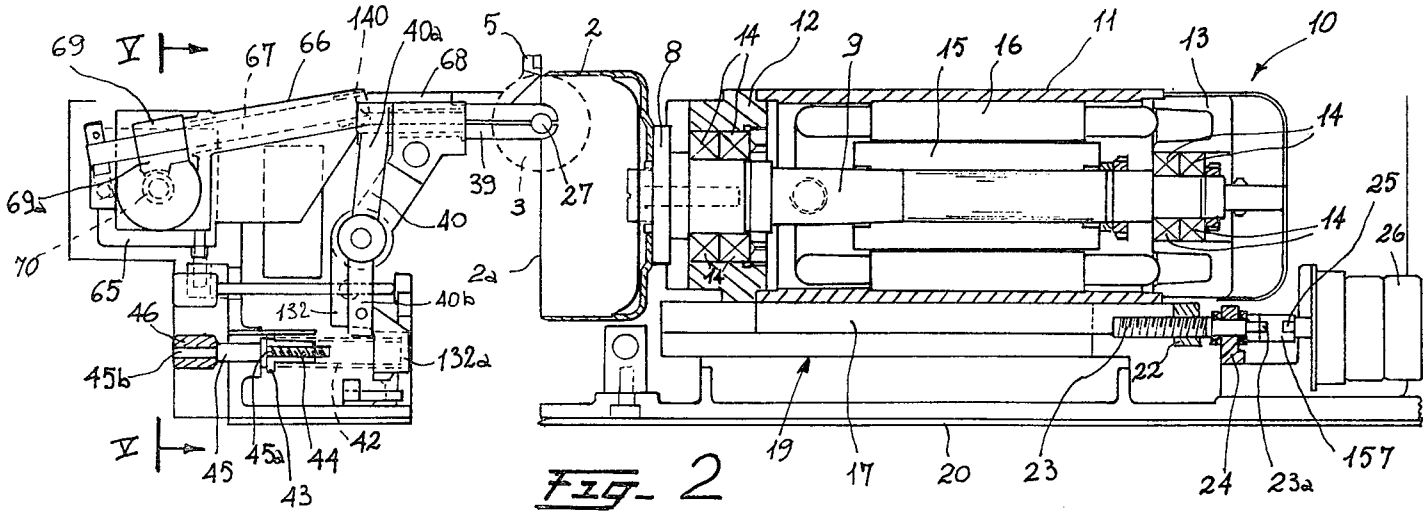
FIG. 2 is a section along the line II—II of FIG. 1.

Referring particularly to FIGS. 1 and 2, the rotary cup-shaped blade 2 is mounted, by means of screws, on a flange 8 connected to the outlet end of a shaft 9 forming part of an electric motor generally indicated at 10.

The electric motor 10 comprises a casing 11 in which are formed supports 12 and 13 housing bearings 14. Rotor windings 15 are mounted on the shaft 9 while field windings 16 are fixed, in a known manner, to the inner surface of casing 11, in correspondence with said rotor windings 15.

Figure 3:
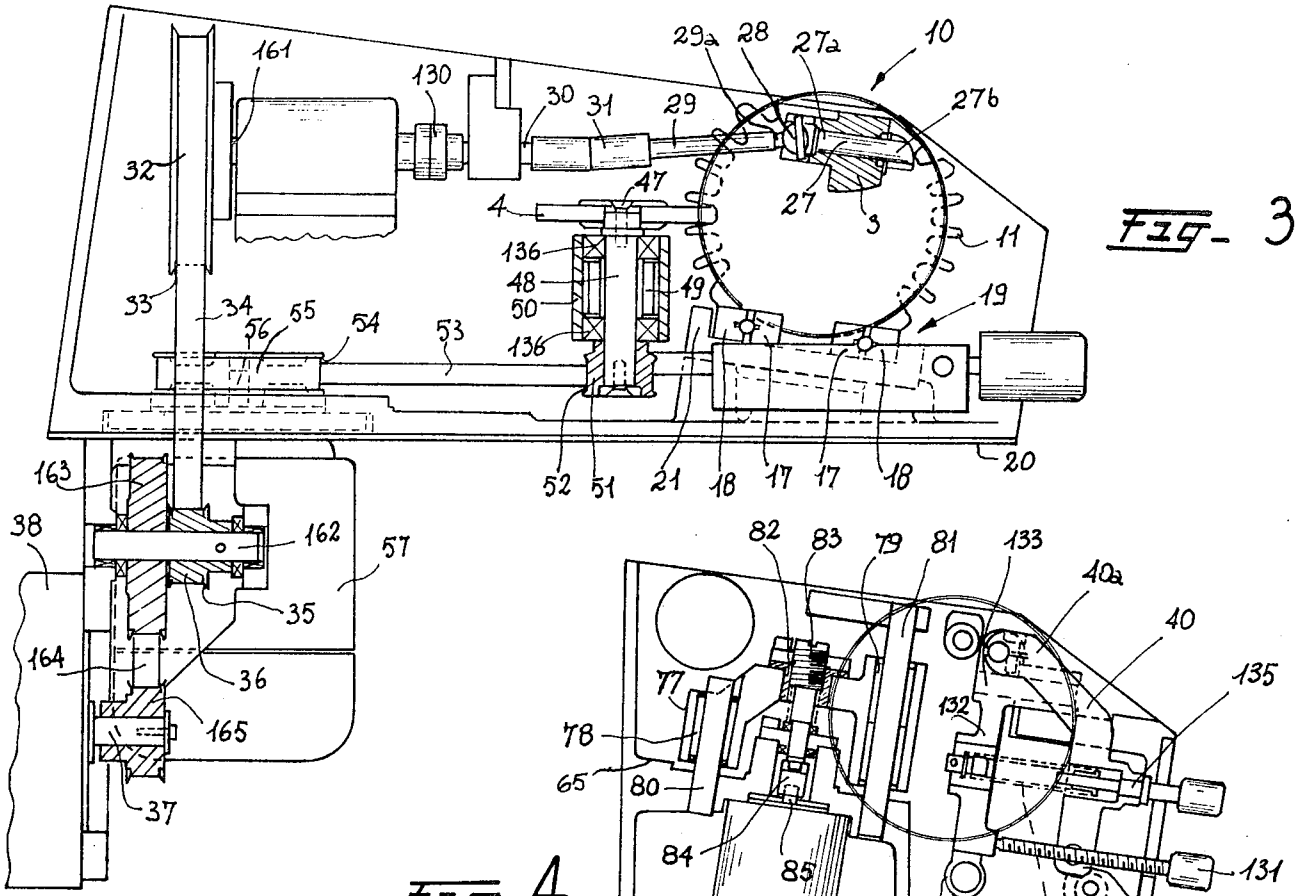
FIG. 3 is a section along the broken line III—III of FIG. 1.

Referring to FIGS. 2 and 3, the casing 11 of the electric motor 10 is provided with ball slidable guides or rollers generally indicated at 19. More particularly, the casing 11 is rigidly mounted on a pair of movable guides 17 which slidably engage in corresponding fixed counterguides 18 secured to a support 21 integral to the bottom of the box-shaped body 20.

A threaded sleeve 22 (FIG. 2) is mounted between the movable guides 17, integrally thereto and operatively engages a threaded pin 23. The threaded pin 23 is supported by a fixed support 24 to both sides of which are disposed two thrust bearings 160 and which is connected, at one end 23*a* thereof, to the outlet end 25 of the shaft of an electric motor 26, by means of a joint. By operating the motor 26 the threaded pin 23 rotates, which causes the sleeve 22 to move forward or backward according to the rotation imparted to the shaft of the motor 26. As sleeve 22 is integral to movable guides 17 and to casing 11 to the electric motor 10, a displacement of same causes a similar displacement of the whole motor 10 and consequently of the rotary cup-shaped blade 2.

The cutting edge 2*a* of the cup-shaped blade 2 is associated with a member forming part of an electronic means, which will be described later in more detail and which is capable of detecting the position of said cutting edge 2*a*. Said detecting member reveals the relative position of the cutting edge 2*a* with respect to a fixed reference or line zero.

Referring to FIGS. 1 to 3, a feed roller 3 is rotatably mounted on a swinging pin 27, one end 27*a* of which is connected, through a knuckle-joint, to one end 29*a* of a rod 29 connected, at its other end, to a drive shaft 30, by way of a joint 31. In order to allow the opening of the box-shaped body 20, the shaft 30 is joined at 130 to another shaft 161 to the free end of which is fitted an idler pulley 32; a driving belt 34 engages in the race 33 of said pulley 32, said belt being also engaged in the race 35 of a pulley 36 fitted to a countershaft 162 together with another pulley 163. Pulley 163 is provided with a belt 164 which also engages a pulley 165 fitted to the outlet end 37 of the shaft of a variable speed electric motor 38.

By operating the electric motor 38, through the driving belts 34 and 164, the shafts 30 and 161 and the rod 29, a rotary motion is imparted to the feed roller 3; the latter, being disposed close to the cutting edge 2*a* of the rotary cup-shaped blade 2, brings the material to be worked to a cutting station.

Figure 4:
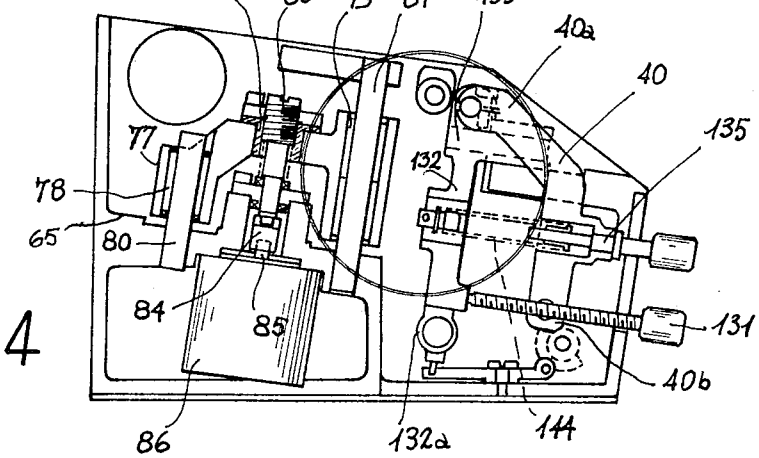
FIG. 4 is a section along the line IV—IV of FIG. 1.

The pin 27 is supported, at its other end 27*b*, upon an arm 39 which is rigidly connected to one end 40*a* of a lever 40 pivoted at 140 and the other end of which abuts, by way of a stop screw 131, against the end 132*a* of another lever 132, the other end of which is pivoted at 133. The end 132*a* engages a counteracting coiled spring 42 the other end of which acts on an annular projection 43 formed on the threaded sleeve 44. A threaded end 45*a* of a rod 45 operatively engages in said sleeve 44, on the other end 45*b* thereof being fitted a handle 46 for manually setting the pressure of roller 3 on the workpiece, at right angles thereto. A spring 144 coiled round an adjusting screw 135 which is located between levers 40 and 132, exerts angular pressure on roller 3 (FIG. 4).

Referring to FIGS. 1 and 3, the grinder 4 is mounted, by a screw 47, on one end of a vertical pin 48. Pin 48 is rotatably mounted on bearings 136 located within a hole 49 formed at one end of a supporting arm 50, while an idler pulley 51 in the race 52 of which is engaged a driving belt 53, is fitted to the other end of said pin. The driving belt 53 also engages in the race 54 of a pulley 55 fitted to the outlet end 56 of the shaft of an electric motor 57.

As is shown in FIG. 1, a takeup pulley 58 is provided in order to prevent the lack of driving belt 53, due to heat or uninterrupted machine use, from causing slipping between the same belt and the idler pulley 51. The takeup pulley 58 includes an arm 59 one end of which is pivoted at 60 while its other end engages with a roller 61 at 62.

A tension spring 63 is coiled round a pin 60 one end 63*a* of said spring being fixed to a peg 64 mounted on arm 59 while the other end 63*b* is fixed to a peg 165 integral to the box-shaped body 30. The action of spring 63 causes roller 61 carried by arm 59 to be kept in contact with belt 53, exerting such an effort on it that the same is constantly under tension.

Figure 5:
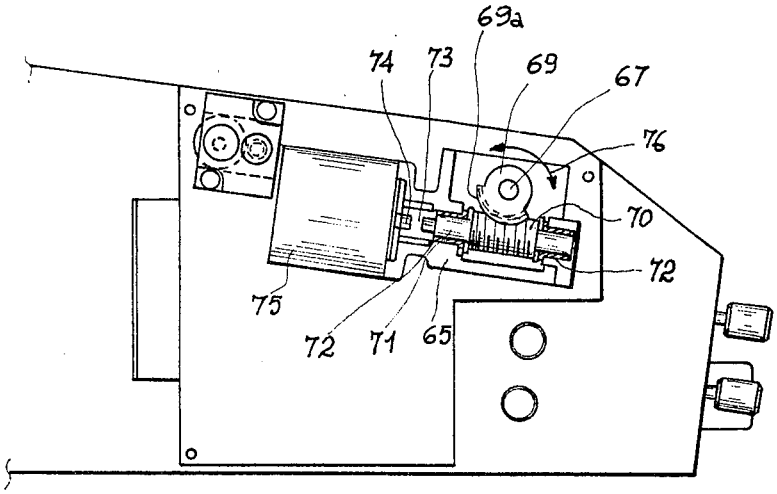
FIG. 5 is a section along the line V—V of FIG. 1.

Referring to FIGS. 2, 4 and 5, it has been indicated at 65 a box-shaped bearing body having a substantially tubular portion 66 in which is rotatbly located a stem 67 carrying, at one end, an arm 68 suitable to support the foot 5 and, at the other end, a wheel 69 one portion of which is provided with helical teeth (section gear 69*a*).

The section gear 69*a* is operatively engaged with a worm-screw 70 integral to a stem 71 rotatably accommodated in suitable housings 72 formed in the box-shaped body 65. One end of stem 71 is connected, through a joint 73, to the outlet end 74 of the shaft of an electric motor 75.

By operating the electric motor 75 the screw 70 rotates and, through sector gear 69*a*, imparts the wheel 69 an oscillating rotary motion according to the arrow 76 in FIG. 5. As the wheel 69 is rigidly fitted on shaft 67, the oscillating rotary motion thereof is integrally transmitted to arm 68 and consequently to foot 5. The angular position taken by foot 5 determines the slope of the chamfer to be made on the workpiece.

The foot 5 can also carry out linear vertical shiftings suitable to determine the chamfering thickness. Such shiftings are obtained by a longitudinal displacement of the whole unit carried by the box-shaped body 65, as described below.

Referring particularly to FIG. 4, the box-shaped body 65 is provided with a projecting portion 77 in which two holes, suitable to accommodate a pair of rods or guide pins 80 and 81 integral to the fixed framework of the machine are formed.

The projecting portion 77 is centrally provided with a further hole housing a threaded sleeve 82 in which is operatively engaged a threaded pin 83 connected by a joint 84 to one outlet end 85 of the shaft of an electric motor 86.

The operation of motor 86 causes the projecting portion 77 to move along the guide pins 80 and 81 and therefore, as this portion is integral to the box-shaped body 65, there is a vertical displacement of the whole unit connected to foot 5, motor 75 included.

There is another type of operation connected to the shape of the chamfer as the latter, in some cases, must have a limited width. In this case, referring to FIG. 7, it is necessary to act on a stop device 87 which restricts the action of the foot by moving backward or forward with respect to the feed roller 3.

Said stop device 87 comprises a rod provided with a peg 88 which engages in a recess 89 formed in a plate 90; the plate 90 is rotatably mounted on a pin 91 integral to the fixed framework of the machine. The plate 90 has a second recess which is disposed at right angles to the recess 89 and which engages with a peg 93 integral to a rod 94 fitted to a stem 95 of an electromagnet 96.

Figure 7:
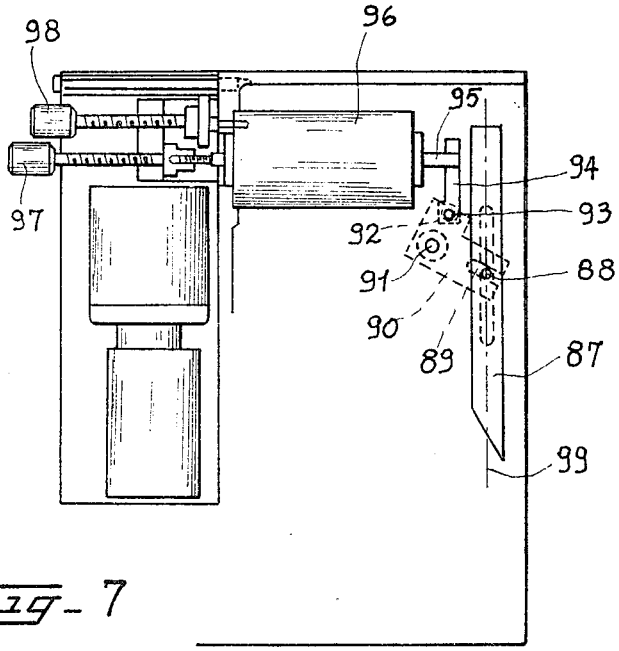
FIG. 7 is a plan view of the stop device intended to limit the width of the chamfer.
Figure 8:
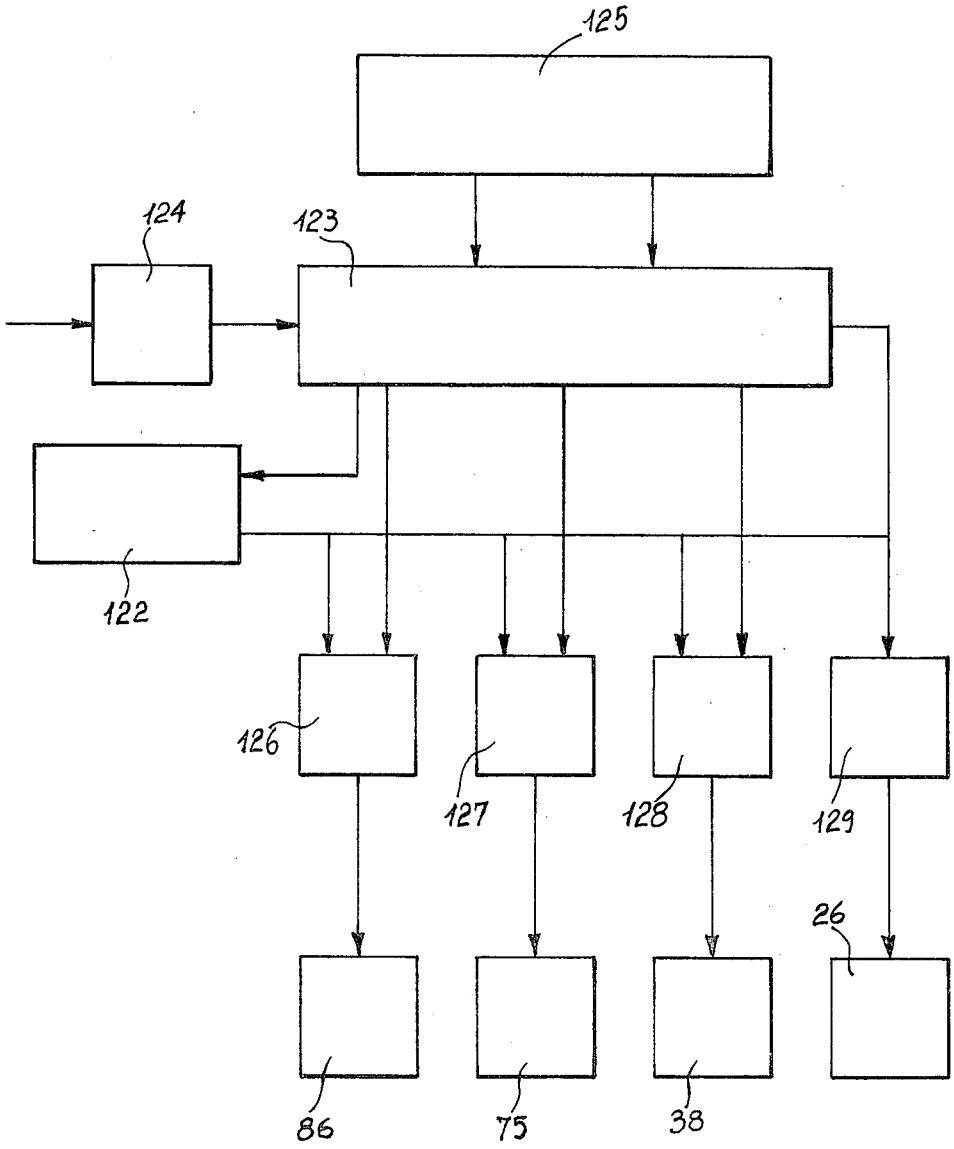
FIG. 8 is a block-diagram of the electronic means associated with the machine according to the invention.

In FIG. 7 handles suitable to set the stop positions of the electromagnet 96 have been indicated at 97 and 98.

By energizing the electromagnet 96 there is a to-and-fro displacement of stem 95 which, through previously described compound lever, transmits to-and-fro motion of stop 87 along an axis 99.

Figure 6:
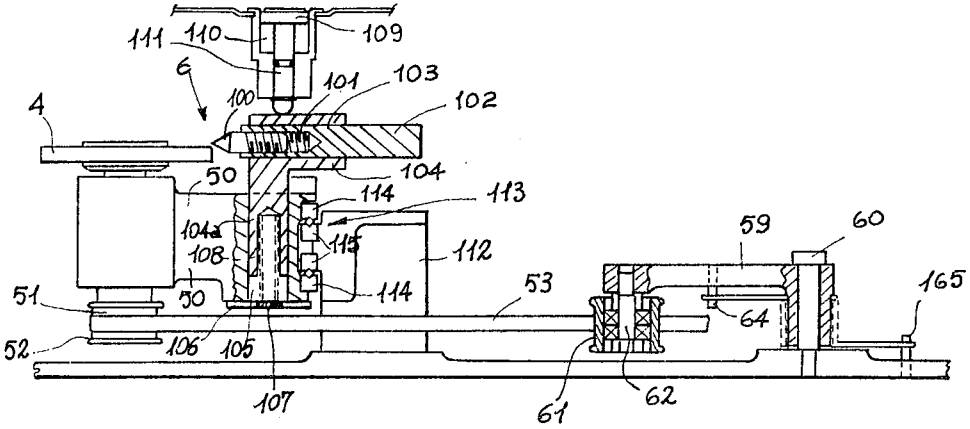
FIG. 6 is a section along the line VI—VI of FIG. 1.

Referring particularly to FIGS. 1 and 6, the member 6 suitable to dress the surface of grinder 4 comprises a headless screw 100 having a diamond point screwed in a threaded hole 101 coaxially formed in a cylindrical shank 102. The cylindrical shank 102, in turn, is slidably mounted in a hole 103 of a point holder body 104 having an extension **104*a* at right angles to hole 103, which slidably engages in a through hole 105 formed in the bearing arm 50 of grinder 4. At its lower part, hole 105 is closed by a plate provided with a small hole 107 allowing passage of a braking fluid, while inside hole 105 there is a counteracting spring 108 which abuts against the extension 104*a* of the point holder body 104 at one side, and against the closure plate 106 at the other side. When it is necessary to dress the grinder the extension 104*a* is caused to slide within the hole 105 by pressing a push-button 109 which is located in a housing 110 formed in the upper part of the box-shaped body and which is provided with a shank 111 by means of which it acts on the upper part of the point holder body 104**.

The dressing member 6, as well as the grinder 4, are supported by a support 112 to which guide rollers 113 are applied.

More particularly, the arm 50 carrying the grinder 4 is provided with movable guides 114 which slidably engage in corresponding counterguides 115 integral to support 112 (FIG. 6).

Turning now to FIG. 1, a pin 116 is mounted on the support 112, which pin carries an idler pulley 117 cooperating with a wire, the end **118*a* of which being fixed to a pin 119 integral to the arm 50 while the other end 118*b* thereof is fixed to a spring 120 secured to the machine box-shaped body 20**.

It is also to be noted that the positioning of headless screw 100 takes place automatically, depending upon the wear of grinder 4. For this purpose a compound lever is provided comprising a two-armed lever 121 centrally pivoted at 170 to the arm 50 of grinder 4 by means of a support **121*a* secured to the arm 50 by a screw 171**.

One arm **121*b* of lever 121 is engaged in a fixed pin 173 by means of a slot while the second arm 121*c* is engaged, at 174, with the cylindrical shank 102 holding the headless screw 100**.

The grinder 4, owing to guide rollers 113 and to spring 118, is kept on a lever with the cup-shaped blade by means of a stop 175 adjustable by a handle 176 on which a boss 177 formed on arm 50 rests.

In proportion as the cutting edge **2*a* of the cup-shaped blade 2 and the grinder 4 get worn, the arm 50 moves forward along the axis of guide roller 113; this forward movement gives rise to a rotation, according to the arrow 178 in FIG. 1, of the two-armed lever 121. This rotation causes the headless screw 100 to be maintained on a level with the grinder 4** in spite of the progressive diameter lessening of the latter, due to wear.

The above described operating members, except member 6, are in a position to execute diversified operating phases on the workpiece repeatedly, according to programs previously planned and stored in electronic means. Such electronic means, which will be described in detail below, when the program is interrupted owing to the necessity of a different single working of the same members, is capable of assuring a complete restoration of interrupted positionings and phases.

Referring particularly to FIG. 9, the above mentioned electronic means comprises a control logic section 122 which is operatively connected to an alarm detecting and feed distributing unit 123 from which it is fed and receives data. Such alarm detecting and feed distributing unit 123 is, in turn, connected to the main, upon interposition of a stabilized transformer 124 and warning devices 125.

The electronic means further comprises a control unit 126 acting on motor 86 which controls the vertical displacement of foot 5, a control unit 127 acting on motor 75 which controls the angular movement of foot 5 and a control unit 128 which actuates the variable speed motor 38 controlling the rotation of the feed roller 3.

The feeding to the control units 126, 127 and 128 is interrupted by the alarm detecting and feed distributing unit 123 when the warning device 125 detects a warning state which is displayed on the control logic section 122, the latter being uninterruptedly fed.

The control logic section 122 is also provided with a memory to record work programs divided into a plurality of phases in which, passage from one phase to the next one is obtained by actuating a control pedal not shown in the figures. Stored programs are retained also without feeding from the main owing to the presence of a battery. Finally, the control logic section 122 includes a console (not shown in the figures) provided with display means and a keyboard suitable to act both on the machine operating members and on the stored phases, for the purpose of carrying out eventual corrections.

According to a further feature of the present invention, further electronic means suitable to determine the positionings of the cup-shaped blade is provided. Such electronic means comprises a control unit 129 acting on the motor 26 which controls axial displacements of the cup-shaped blade 2. The control unit 129 is operable by means of a keyboard which advantageously can be the same keyboard envisaged on the above mentioned console and is fed by the alarm detecting and feed distributing unit 123.

Owing to the presence of the above mentioned means and of the member detecting the positions of the cutting edge 2*a* of the cup-shaped blade 2, it is possible to make the above cutting edge take the most suitable position for a determined working in any moment and in a precise manner. Furthermore, when the cutting edge 2*a* has moved backward because of the sharpening action exerted by the grinder 4, the cup-shaped blade 2 can be returned forward by a continuous or stepped movement so that the cutting edge 2*a* can take a precise positioning, which, in any case, never overcomes the line zero.

The advantage attained with a chamfering machine according to the present invention can be summarized as follows:

the independence of different controls, so that it is possible to act on any of the various operations varying them at will without interfering at all with the others;

the high reliability of the machine due to appropriate dimensions of the different members, so that dead times for extraordinary maintenance are reduced;

the routine maintenance is easier and quicker owing to the rational disposition of the various operating members which can be easily reached;

the work programs can be stored in a non volatile manner and in great number;

the possibility of employing unskilled staff as the positioning of the various members occurs automatically and in a very precise manner;

a very important reduction of dead times during any type of adjustment.

Particularly, with reference to the feed roller, as its control is independent of the other members and as it is able to run at a variable speed, it enables the feeding of the piece which has to be chamfered, according to the kind of material used. That is, if for a determined piece made of some material it is necessary to work at a constant feeding speed, the feed roller is rotated, drivingly, at a preselected constant speed. If, on the contrary, it is necessary to chamfer a piece comprising curvilinear portions and rectilinear portions inserted therebetween, it is possible, acting on a traditional control member such as a pedal, to supply the piece at a low speed when the chamfering operation takes place on a curvilinear portion and to accelerate supplying the piece at high speed when a rectilinear portion has to be chamfered.

It is to be observed, at last, that the machine according to the present invention has a further advantage, given by the dressing member 6. In fact, the latter has been envisaged so that it can follow all the movements of the grinder while in the machines of the known art it was necessary to search for the grinder position; furthermore, by means of the compound lever described above, it can automatically reach the right position taking also into account the wear ratio of the grinder.

Obviously, although a preferred embodiment has been described hereinbefore, the invention is not limited thereto or thereby and modifications can be carried out within the scope of the following claims.

What is claimed is:

1. A machine for chamfering pieces of hide, leather and synthetic materials of small thickness, particularly for shoe and leather factories comprising, within a box-shaped body, a rotary cup-shaped blade, a feed roller for feeding pieces to be chamfered, disposed at right angles and inside said cup-shaped blade with one generatrix thereof substantially on a level with the cutting edge of the blade, a guide foot or guide roller for the material fed thereto, placed above said cup-shaped blade, a grinder to sharpen the cup-shaped blade, disposed laterally to the latter, and a member suitable to dress the grinder surface characterized in that said rotary cup-shaped blade, said material feed roller, said guide foot and said grinder are kinematically disconnected from each other, as they are driven by independent power units, in that said member to dress the grinder surface is provided with adjustment means adapted to set the positioning thereof and in that the foot and the corresponding stop device can repeatedly carry out diversified operating phases on the workpiece according to different operating programs previously stored in electronic means, said phases being suitable to be repeated at will according to a control on the part of the operator, the automatic working being arranged to be interrupted at any moment in order to carry out a different single working of the same members and to be restored, after such single working, according to the programmed cycle, said electronic means being also able to detect the reference position of the cup-shaped blade and to determine the different positionings of same according to its wear and to the pieces to be worked by means of either continuous or stepped displacements of said blade.

2. A chamfering machine according to claim 1, characterized in that said cup-shaped blade is mounted on a flange placed at one end of a shaft of an electric motor the casing of which is integral to a pair of movable guides disposed parallelly to said shaft and slidably engaged with a pair of counterguides fixed to the machine framework, driving means being provided in order to impart a to-and-fro motion to said movable guides.

3. A chamfering machine according to claim 2, characterized in that said driving means includes a support integral to the fixed framework of the machine, and an electric motor the shaft of which is connected, through a joint, to a threaded pin operatively engaged in a sleeve integral to said movable guides.

4. A chamfering machine according to claim 1, characterized in that said feed roller is rotatably mounted on an oscillating pin and is rotated by a first shaft, one end of which is connected to said roller while the other end is connected to a second shaft which receives the rotary motion through gears comprising belts and pulleys.

5. A chamfering machine according to claim 1, characterized in that said grinder is mounted on one end of a pin supported by a movable arm and carrying at its other end a pulley in which a driving belt is engaged, said belt being also engaged with another pulley fitted to the outlet end of the shaft of an electric motor.

6. A chamfering machine according to claim 1, characterized in that said member suitable to dress the grinder surface comprises a headless screw having a diamond point mounted on a cylindrical shank carried by a point-holding body which is axially slidable in a hole of the grinder arm, said arm being slidably mounted on a fixed support so that it can keep the grinder on a level with the cutting edge of the blade by means of a wire and a spring, said headless screw being constantly kept on a level with the grinder by means of a compound lever.

7. A chamfering machine according to claim 1, characterized in that said compound lever includes a two-armed lever centrally pivoted to the grinder arm by means of a support secured to said grinder arm, one arm of said lever being engaged, by means of a slot, in a fixed pin while the other arm is engaged with the cylindrical shank carrying the headless screw.

8. A chamfering machine according to claim 1, characterized in that said electronic means comprises a control logic section which receives data from and is fed by an alarm detecting and feed distributing unit connected to the main and provided with warning devices, said control logic section feeding, in turn, a motor control unit controlling the vertical movement of the foot, a motor control unit controlling the angular movement of the foot and a motor control unit controlling the rotation of the feed roller at a variable speed, said alarm detecting and feed distributing unit interrupting the feeding to said control units when the warning devices detect a warning state which is displayed on the control logic section which is uninterruptedly fed.

9. A chamfering machine according to claim 7, characterized in that said control unit section comprises a memory to record work programs divided into a plurality of phases, the passage from one phase to the next one being obtained by means of a pedal control, a battery to retain the program in the absence of feeding from the main, display means and a keyboard suitable to act on the operating machine members and to correct each of said stored phases.

10. A chamfering machine according to claim 1, characterized in that said electronic means, in order to determine the displacements of the cup-shaped blade, comprises a detecting member and a control unit controlling the axial displacements of said cup-shaped blade, actuated by means of a keyboard and fed by the alarm detecting and feed distributing unit.

* * * * *